US006591251B1

(12) United States Patent
Leon et al.

(10) Patent No.: US 6,591,251 B1
(45) Date of Patent: Jul. 8, 2003

(54) METHOD, APPARATUS, AND CODE FOR MAINTAINING SECURE POSTAGE DATA

(75) Inventors: JP Leon, San Carlos, CA (US); Albert L. Pion, Keon, OR (US); Elizabeth A. Simon, Keno, OR (US)

(73) Assignee: Neopost Inc., Hayward, CA (US)

( * ) Notice: Subject to any disclaimer, the term of this patent is extended or adjusted under 35 U.S.C. 154(b) by 0 days.

(21) Appl. No.: 09/358,802

(22) Filed: Jul. 21, 1999

Related U.S. Application Data

(60) Provisional application No. 60/093,849, filed on Jul. 22, 1998, provisional application No. 60/094,065, filed on Jul. 24, 1998, provisional application No. 60/094,073, filed on Jul. 24, 1998, provisional application No. 60/094,116, filed on Jul. 24, 1998, provisional application No. 60/094,120, filed on Jul. 24, 1998, provisional application No. 60/094, 122, filed on Jul. 24, 1998, and provisional application No. 60/094,127, filed on Jul. 24, 1998.

(51) Int. Cl.[7] ..... G07B 17/04
(52) U.S. Cl. ..... 705/60; 705/401; 705/410
(58) Field of Search ..... 705/60, 401, 410

(56) References Cited

U.S. PATENT DOCUMENTS

| | | | | |
|---|---|---|---|---|
| 4,181,245 A | | 1/1980 | Garrett et al. | |
| 4,447,890 A | | 5/1984 | Duwel et al. | |
| 4,484,307 A | * | 11/1984 | Quatse et al. | 705/410 |
| 4,506,344 A | * | 3/1985 | Hubbard | 705/401 |
| 4,657,697 A | | 4/1987 | Chiang | |
| 4,725,718 A | | 2/1988 | Sansone et al. | |
| 4,742,469 A | * | 5/1988 | Haines et al. | 705/410 |
| 4,743,747 A | | 5/1988 | Fougere et al. | |
| 4,757,537 A | | 7/1988 | Edelmann et al. | |
| 4,775,246 A | | 10/1988 | Edelmann et al. | |
| 4,812,965 A | * | 3/1989 | Taylor | 705/401 |
| 4,813,912 A | * | 3/1989 | Chickneas et al. | 705/408 |
| 4,831,555 A | | 5/1989 | Sansone et al. | |
| 4,853,865 A | | 8/1989 | Sansone et al. | |

(List continued on next page.)

FOREIGN PATENT DOCUMENTS

| | | |
|---|---|---|
| EP | 825 565 A2 | 2/1998 |
| EP | 845 762 A2 | 6/1998 |
| GB | 1 536 403 | 12/1978 |
| WO | 98/46790 A1 | 4/1998 |
| WO | 98/20461 A2 | 5/1998 |
| WO | 00/49580 A1 | 8/2000 |

OTHER PUBLICATIONS

"Information–Bases Indicia Program (IBIP), Performance Criteria for Information–Based Indicia and Security Architecture for Closed IBI Postage Metering Systems (PCIBI–C)" Jan. 12, 1999 (1999–01–12), United States Postal Sercive, dated Jan. 12, 1999.

"Information Based Indicia Program (IBIP) Indicium Specification," United States Postal Service, dated Jun. 13, 1996.

Information Based Indicia Program Postal Security Device Specification, United States Postal Service, dated Jun. 13, 1996.

(List continued on next page.)

*Primary Examiner*—Edward R. Cosimano
(74) *Attorney, Agent, or Firm*—Townsend and Townsend and Crew LLP

(57) ABSTRACT

A postage metering system configurable to execute a security routine that inhibits certain transactions but maintains secure postage data. The system includes a security module coupled to a postage meter. The security module executes a set of transactions with the meter, and includes a processor and a memory. The processor executes a security routine upon occurrence of one or more defined events. The memory stores secure postage data. When the security routine is executed, selected ones of transactions between the meter and security module are inhibited, but the secure postage data stored within the memory is retained. The memory can also store security data (e.g., encryption keys) that are erased when the security routine is executed. The security routine can be initiated upon: (1) failure to receive an authorization signal by the security module within a particular time-out period, (2) detection of tampering with the security module, (3) receipt of a command from the meter, or other events.

30 Claims, 2 Drawing Sheets

U.S. PATENT DOCUMENTS

| | | | | | |
|---|---|---|---|---|---|
| 4,853,961 | A | | 8/1989 | Pastor | |
| 4,949,381 | A | | 8/1990 | Pastor | |
| 5,142,577 | A | | 8/1992 | Pastor | |
| 5,231,668 | A | | 7/1993 | Kravitz | |
| 5,280,531 | A | | 1/1994 | Hunter | |
| 5,377,268 | A | | 12/1994 | Hunter | |
| 5,448,641 | A | | 9/1995 | Pintsov et al. | |
| 5,555,373 | A | * | 9/1996 | Dayan et al. | 713/202 |
| 5,574,786 | A | * | 11/1996 | Dayan et al. | 713/202 |
| 5,612,884 | A | * | 3/1997 | Haines | 705/403 |
| 5,625,694 | A | | 4/1997 | Lee et al. | |
| 5,638,442 | A | | 6/1997 | Gargiulo et al. | |
| 5,666,421 | A | | 9/1997 | Pastor et al. | |
| 5,688,056 | A | | 11/1997 | Peyret | |
| 5,715,164 | A | | 2/1998 | Liechti, deceased et al. | |
| 5,719,775 | A | * | 2/1998 | Abumehdi | 705/410 |
| 5,740,232 | A | * | 4/1998 | Pailles et al. | 379/93.26 |
| 5,742,683 | A | | 4/1998 | Lee et al. | |
| 5,757,909 | A | * | 5/1998 | Park | 380/201 |
| 5,781,438 | A | | 7/1998 | Lee et al. | |
| 5,793,867 | A | | 8/1998 | Cordery et al. | |
| 5,822,738 | A | | 10/1998 | Shah et al. | |
| 5,848,401 | A | * | 12/1998 | Goldberg et al. | 705/408 |
| 5,920,850 | A | | 7/1999 | Hunter et al. | |
| 5,963,928 | A | | 10/1999 | Lee | |
| 5,970,227 | A | * | 10/1999 | Dayan et al. | 713/200 |

OTHER PUBLICATIONS

"Information Based Indicia Program Host System Specification [Draft]," United States Postal Service, dated Oct. 9, 1996.

"Information–Based Indicia Program (IBIP), Performance Criteria for Information–Based Indicia and Security Architecture for IBI Postage Meeting Systems (PCIBISAIBI-PMS)," United States Postal Service, dated Aug. 19, 1998.

United States Postal Service, "Performance Criteria For Information–Based Indicia And Security Architecture For Open IBI Postage Evidencing Systems," Information Based Indicia Program (IBIP), Jun. 25, 1999 XP–002161216.

BARKER–BENFIELD, "First Union Offers Online Transactions,"*Florida Times–Union*, Jan. 28, 1994.

FIBS PUB 140–1, Federal Information Processing Standards Publication, (Jan. 11, 1994) Security Requirements for Crytographic Modules, U.S. Department of Commerce, Ronald H. Brown, Secretary, National Insitute of Standards and Technology; pp:1–51.

* cited by examiner

METHOD, APPARATUS, AND CODE FOR MAINTAINING SECURE POSTAGE DATA

CROSS-REFERENCES TO RELATED APPLICATIONS

This application claims priority from the following U.S. provisional and non-provisional applications, the disclosures of which, including software appendices and all attached documents, are incorporated by reference in their entirety for all purposes:

Application Serial No. 60/093,849, entitled "Method and Apparatus for Postage Label Authentication," filed Jul. 22, 1998, of JP Leon and David A. Coolidge;

Application Serial No. 60/094,065, entitled "Method and Apparatus for Resetting Postage Meter," filed Jul. 24, 1998, of JP Leon;

Application Serial No. 60/094,073, entitled "Method, Apparatus, and Code for Maintaining Secure Postage Information," filed Jul. 24, 1998, of JP Leon, Albert L. Pion, and Elizabeth A. Simon;

Application Serial No. 60/094,116, entitled "Method and Apparatus for Dockable Secure Metering Device," filed Jul. 24, 1998, of JP Leon;

Application Serial No. 60/094,120, entitled "Method and Apparatus for Remotely Printing Postage Indicia," filed Jul. 24, 1998, of Chandrakant J. Shah, JP Leon, and David A. Coolidge;

Application Serial No. 60/094,122, entitled "Postage Metering System Employing Positional Information," filed Jul. 24, 1998, of JP Leon;

Application Serial No. 60/094,127, entitled "Method and Apparatus for Operating a Removable Secure Metering Device," filed Jul. 24, 1998, of JP Leon; and application Ser. No. 09/250,990, filed Feb. 16, 1999, now U.S. Pat. No. 6,424,954, entitled "Postage Meter System", of JP Leon.

The following related patent applications filed on the same day herewith are hereby incorporated by reference in their entirety for all purposes:

U.S. patent application Ser. No. 09/359,158, filed Jul. 21, 1999, now U.S. Pat. No. 6,341,274, entitled "Method and Apparatus for Operating a Secure Metering Device," of JP Leon;

U.S. patent application Ser. No. 09/358,801, filed Jul. 21, 1999, entitled "Method and Apparatus for Postage Label Authentication," of JP Leon;

U.S. patent application Ser. No. 09/359,163, filed Jul. 21, 1999, entitled "Postage Metering System Employing Positional Information," of JP Leon;

U.S. patent application Ser. No. 09/359,162, filed Jul. 21, 1999, entitled "Method and Apparatus for Resetting Postage Meter," of JP Leon; and U.S. patent application Ser. No. 09/358,511, filed Jul. 21, 1999, entitled "Method and Apparatus for Remotely Printing Postage Indicia," of Chandrakant J. Shah, JP Leon, and David A. Coolidge.

BACKGROUND OF THE INVENTION

The present invention relates generally to postage metering systems, and more particularly to a method, apparatus, and code for maintaining secure postage data.

A postage meter allows a user to print postage or other indicia of value on envelopes or other media. The postage meter can be leased or rented from a commercial group (e.g., Neopost). Conventionally, the user purchases a particular amount of value beforehand and the meter is programmed with this amount. Subsequently, the user is allowed to print postage up to the programmed amount. Some modern postage meters allow the user to purchase additional amounts via a communications link (e.g., a telephone modem or the Internet).

Because a postage meter is capable of printing postage having a value, security is critical to prevent unauthorized use. The meter typically includes a print mechanism and electronic control circuitry that directs the operation of the print mechanism. The control circuitry (and possibly the print mechanism) are typically enclosed in a secure housing that prevents tampering with the meter and unauthorized access by anyone except for authorized factory technicians. The meter can include sensors that detect tampering with the meter and flag such condition. Examples of secure postage meters are disclosed in U.S. Pat. No. 4,742,469, entitled "Electronic Meter Circuitry," issued May 3, 1988, U.S. Pat. No. 4,484,307, entitled "Electronic Postage Meter Having Improved Security and Fault Tolerance Features," issued Nov. 20, 1984, and the aforementioned U.S. Pat. No. 6,424,954, all three assigned to the assignee of the present invention and incorporated herein by reference.

With the advent of electronic control circuitry, meter security is typically provided by digital signature, encryption, and other techniques. These techniques allow for electronic detection of meter tampering, e.g., attempts to modify the normal operation of the accounting registers used to store value.

Another technique for providing security is through the use of a smart card or cartridge. The smart card couples to the associated system and stores important data (e.g., security data) that enables the operation of the system to which it couples. For example, the smart card can contain secret pass codes, encryption keys, authorization codes, and so on. The smart card can be modified or replaced, as necessary, if its integrity is suspected.

Smart cards are used in some applications where security frauds are encountered. For example, U.S. Pat. No. 5,740,232 discloses a smart card based system for telephone-securized transactions. Also, U.S. Pat. No. 5,757,909 discloses the use of a smart card to prevent illegal users from viewing and copying a digital video stream.

Conventionally, automatic security arrangements for smart card based systems operate by resetting bits on the smart card to a particular value (e.g., zero). The reset prevents unauthorized operation with the smart card, which is desired. Unfortunately, the reset also destroys valuable data on the card. In applications in which the data is financial data (e.g., a postage revenue credit), this reset can be equivalent to a loss of cash.

SUMMARY OF THE INVENTION

The invention provides method, apparatus, and code that provide security for a postage metering system but maintain (or retain) secure postage data stored therein. The invention is especially suited for a postage metering system that includes a security module coupled to a postage meter. In an embodiment, a security routine is executed upon occurrence of one or more defined events. Execution of the security routine inhibits certain transactions between the security module and that meter but maintains (or retains) the secure postage data stored in the security module.

An embodiment of the invention provides a postage metering system that includes a security module operatively coupled to a meter. The meter is configurable to perform a set of metering operations. The security module executes a set of transactions with the meter, and includes a processor and a memory. The processor executes a security routine upon occurrence of one or more defined events. The memory stores secure postage data. When the security routine is executed, selected ones of transactions between the meter and security module are inhibited, but the secure postage data stored within the security module is retained. The security module can also store security data (e.g., encryption keys) that are erased when the security routine is executed. The security module can (and typically does) include additional circuitry that supports the security process (e.g., a timer, sensors, and so on).

The security routine can be initiated upon: (1) failure to receive an authorization signal by the security module within a particular time-out period, (2) detection of tampering with the security module, (3) receipt of a (shut-down) command from the meter, or other events.

Another embodiment of the invention provides a method for executing a security routine within a postage metering system that includes a security module coupled to a meter. In accordance with the method, occurrence of one or more defined events within the postage metering system is detected. The security routine is then initiated upon the detected occurrence of the one or more events. Upon execution of the security routine, selected ones of transactions between the meter and the security module are inhibited and secure postage data stored within a memory in the security module is retained.

Again, the security routine can be initiated if an authorization signal is not received within a time-out period or if tampering with the security module is detected. A count indicative of a time period since a last receipt of the authorization signal can be maintained, and this count can be reset if the authorization signal is received within the time-out period.

The invention also provides computer-implemented program products that implement the method described above.

The foregoing, together with other aspects of this invention, will become more apparent when referring to the following specification, claims, and accompanying drawings.

DESCRIPTION OF THE SPECIFIC EMBODIMENTS

Figure 1:
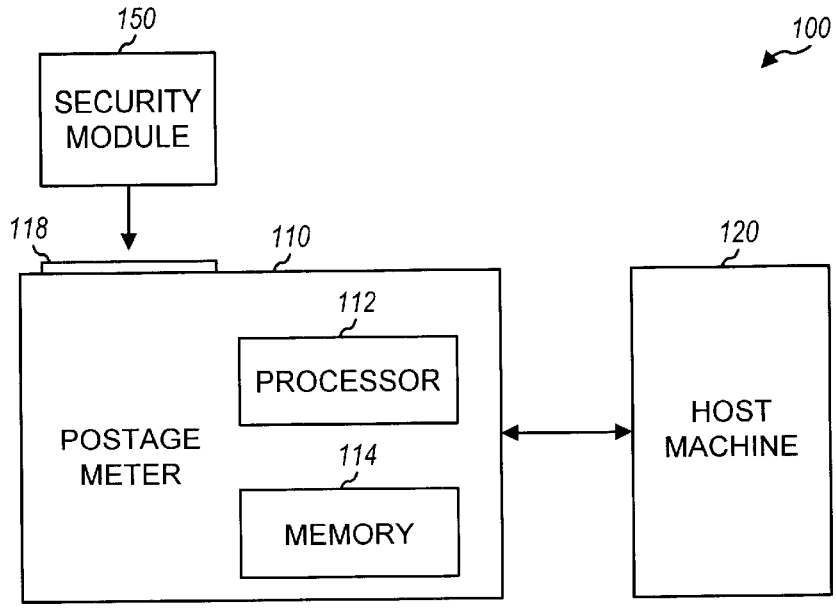
FIG. 1 is a block diagram of an embodiment of a postage metering system.

FIG. 1 is a simplified block diagram of an embodiment of a postage metering system 100. Metering system 100 includes a postage meter 110 coupled to a host machine 120. Meter 110 includes a processor 112 and a memory 114, and can include additional subsystems such as, for example, a print mechanism, input/output (I/O) interfaces, communication devices (e.g., modems), and so on (not shown in FIG. 1). Subsystems that can be included within meter 110 are described in the aforementioned U.S. Pat. No. 6,424,954 and in U.S. Pat. No. 5,612,884, entitled "Remote Meter Operation," issued Mar. 18, 1997, both assigned to the assignee of the invention and incorporated herein by reference.

Postage metering system 100 can be designed and operated in many configurations. In one specific configuration, meter 110 operates as a stand-alone unit, being functional without host machine 120, and is capable of dispensing postage indicia having values. In another specific configuration, meter 110 couples to, and operates in conjunction with, host machine 120. Communication between meter 110 and host machine 120 can be achieved via a software protocol. One such system and protocol is disclosed in the aforementioned U.S. Pat. No. 6,424,954.

Meter 110 is configurable to perform a set of metering operations. These operations can include, when authorized, printing of postage indicia, download of funds, auditing of the meter, and so on. Meter 110 can provide additional functions when operated in conjunction with host machine 120, such as remote reloading of additional funds from a postal provider. Metering operations are further described in the aforementioned U.S. Pat. No. 6,424,954.

The print mechanism for imprinting postage indicia can be incorporated into meter 110. Alternatively, the print mechanism can be a standard printer that couples to meter 110 or host machine 120, or both.

In the embodiment shown in FIG. 1, meter 110 further includes a connector 118 for coupling to a security module 150. Security module 150 can also operatively couple to meter 110 through a radio link, an optical link, an infrared link, or other communications links.

In an embodiment, security module 150 is configured to store secure postage data such as accounting and revenue values, cryptographic keys, and so on. Security module 150 can further be configured to perform security functions associated with the postage metering system, as described below. In an embodiment, security module 150 includes many of the security features described for a secure metering device (SMD) in the aforementioned U.S. Pat. No. 6,424,954.

Examples of other postage metering systems that can incorporate the invention are described in the aforementioned U.S. Pat. No. 6,424,954 and in U.S. patent application Ser. No. 09/359,158, now U.S. Pat. No. 6,341,274. Other postage metering systems can also be adapted for use with the invention and are within the scope of the invention.

Figure 2:
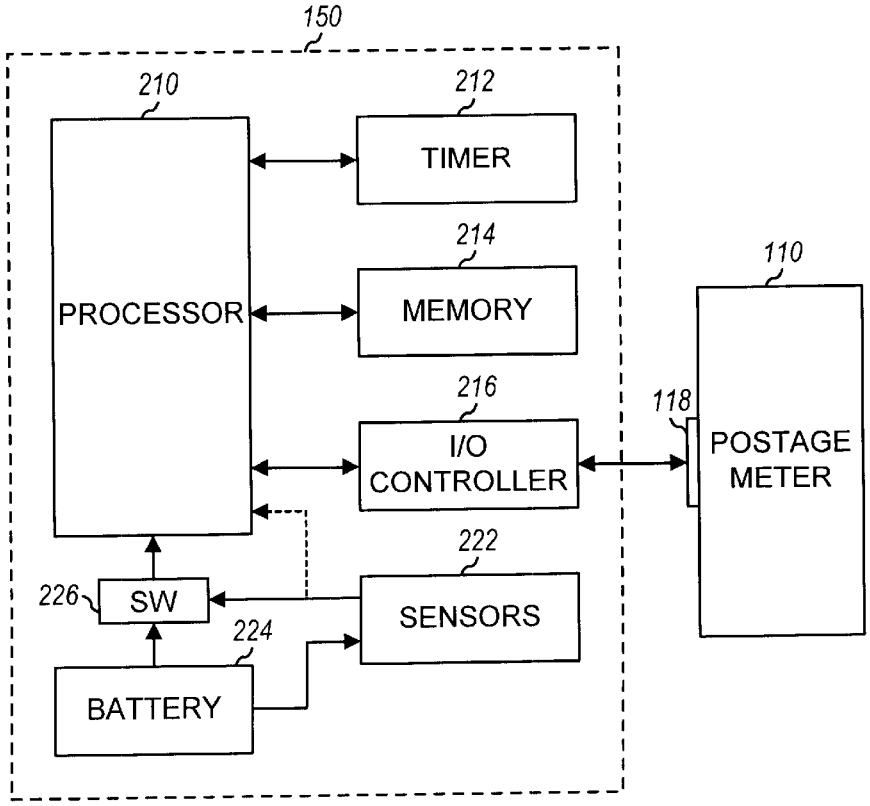
FIG. 2 is a block diagram of an embodiment of a security module.

FIG. 2 is a block diagram of an embodiment of security module 150. Security module 150 includes a processor 210 coupled to a timer 212, a memory 214, and an I/O controller 216. These units can be enclosed within a secure (e.g., tamper-evident and/or tamper-resistant) housing. Timer 212, memory 214, and I/O controller 216 can be implemented as separate circuits, integrated into one or more circuits, or incorporated into processor 210. I/O controller 216 couples to connector 118 of meter 110 and supports communication between security module 150 and meter 110. The power necessary to operate security module 150 can be provided from meter 110 through connector 118, or can come from a battery 224.

Processor 210 can be implemented with a microcomputer, a microprocessor, a controller, a signal processor, an application specific integrated circuit (ASIC), or other electronic units designed to perform the functions described herein. Memory 214 can be implemented as a random-access memory (RAM), a dynamic RAM (DRAM), a read-only memory (ROM), a programmable ROM (PROM), an electronically programmable ROM (EPROM), a FLASH memory, a battery augmented memory (BAM), a battery backed-up RAM (BBRAM), other memory devices, or any combination thereof.

Memory 214 can be configured to store program codes and data. Memory 214 can store secure postage data such as, for example, accounting values normally associated with revenue registers (e.g., ascending and descending registers). Memory 214 can also store security data such as, for example, cryptographic keys used to effectuate secure data transfer. In an embodiment, some data (e.g., a public encryption key) can be provided from security module 150 to the associated meter 110 via a secured communication between the two units. In an embodiment, some data (e.g., revenue values) are not sent outside security module 150, and can only be altered by security module 150 via a secured transaction with meter 110.

Timer 212 can be implemented with a counter that operates from a clock signal. The counter further includes a reset input that receives a reset signal (e.g., an authorization signal) used to reset the counter (e.g., to zero). Generally, timer 212 is designed to maintain a record of a time period since a last reset signal was received, and to compare this time period against a particular time-out period. Based on the result of the comparison, timer 212 generates an alert signal that is provided to processor 210. The time-out period can be preprogrammed at the factory or programmable in the field (e.g., via a secured transaction with meter 110), or both.

In an embodiment, security module 150 further includes sensors 222 of various types that detect and report tampering with security module 150. Examples of sensors 222 are disclosed in the aforementioned U.S. Pat. Nos. 6,424,954 and 4,742,469 and 4,484,307. For example, sensors 222 can detect when the secure housing has been tampered or opened, and can provide an alert signal to processor 210 (via the dashed line in FIG. 2) to indicate a detected tampering with security module 150. Sensors 222 can be designed to operate from battery 224, or designed as a mechanical unit, such that sensors 222 are operational even when no external power is applied to security module 150.

In some embodiments, security module 150 also includes battery 224 and a switching circuit (SW) 226, both located within the secure housing. Switching circuit 226 couples battery 224 to processor 210, and is activated by a control signal from sensors 222. The operations of sensors 222, battery 224, and switching circuit 226 are further described below.

Security module 150 can be packaged in numerous forms. For example, security module 150 can be packaged as a smart card, a cartridge, a module, an electronic key, and others. Implementation and operation of security module 150 as a removeable and/or dockable device are described in the aforementioned U.S. patent application Ser. No. 09/359,158, now U.S. Pat. No. 6,341,274.

In accordance with the invention, security module 150 is provided with a security routine that protects against fraud and tampering. In an embodiment, the security routine is downloaded to the security module by one or more of the following entities: (1) a service center, (2) a central dispatch facility, (3) the postal authorities, (4) the manufacturer, and others. Hereinafter, these entities are collectively referred to as the "service center," which generically refers to any entity that may have extended access to security module 150. In another embodiment, the security routine is electronically (and securely) loaded from a suitable device, such as meter 110. This embodiment allows the security routine to be updated as necessary. The security routine can be stored in memory 214, processor 210, or other suitable units within security module 150.

In another embodiment, the security routine can reside within meter 110. Meter 110 executes the routine and sends the necessary signals to security module 150. In this embodiment, the security routine can be stored in memory 114. For simplicity, the invention is described for the embodiment in which the security routine is located within security module 150.

The security routine can be a computer program product that is written in one or a combination of programming languages. For example, the security routine can be written in C, C++, Basics, Fortran, Pascal, assembly, and other languages. The security routine can also be implemented with microcodes that are stored or hardwired within security module 150 (e.g., within processor 210) and configured to control the operation of the hardware. Various implementations of the security routine can be contemplated and are within the scope of the invention.

In some embodiments, security module 150 includes security data such as encryption keys, secret codes, or the like, that authorizes and authenticates a set of transactions between security module 150 and meter 110. For example, security module 150 can be provided with a set of (public and private) encryption keys used to sign outgoing messages and authenticate incoming messages. These messages can be used to control the print mechanism coupled to meter 110. Encryption keys are also used in transactions that cause modification of accounting values stored within security module 150. These various transactions are described in more detail in the aforementioned U.S. Pat. No. 6,424,954. In an embodiment, the execution of the security routine causes erasure of the security data within security module 150, such as the encryption keys. This provides protection against fraud and tampering since it effectively renders security module 150 non-operational. However, secure postage data, such as accounting values, is retained and may be retrieved by an authorized entity.

Execution of the security routine can also inhibit certain transactions between security module 150 and meter 110. For example, secure transactions that depend on the encryption keys within the security module are rendered non-functional when these keys are erased by the security routine. Other transactions (e.g., unsecured transactions) that do not depend on erased security data can also be inhibited by the security routine.

Execution of the security routine is initiated upon occurrence of one or more defined events. One such event can be a failure to periodically receive an authorization signal from meter 110. Another event can be detection of tampering with security module 150. Yet another event can be a command from meter 110 to shut down operation. These events are described below.

One event that can initiate execution of the security routine is a failure to receive, within a particular time-out period, an authorization signal from an associated meter 110 (i.e., the host device) to which security module 150 couples. The time-out period is also referred to as a programmed interval or programmed delay. In an embodiment, in normal operation, security module 150 receives the authorization signal from the associated meter 110 before expiration of the time-out period. A timer maintains record of the time period since the last receipt of the authorization signal. Upon receiving the authorization signal, the timer is reset and the security routine temporarily inhibited. If security module 150 is powered up for a time period longer than the time-out period without receiving the authorization signal, as indicated by the timer, processor 210 initiates execution of the security routine. In a specific embodiment, the time-out period is selected to be on the order of milli-seconds (msecs), to make the authorization signal imperceptible to the user. In other embodiments, other time-out periods (e.g., less than a second, seconds, hours, and so on) can also be used. The time-out period can be fixed (e.g., at the factory) or programmable (e.g., via a secured transaction).

Another event that can initiate execution of the security routine is detection of tampering with security module 150. For example, sensors 222 can monitor the integrity of the secure housing and provide a control signal to switching circuit 226 in response to a detected tampering. Specifically, sensors 222 can send the control signal if the secure housing is opened or stressed. As another example, sensors 222 can also monitor the I/O signals for the security module and report abnormal activities.

In an embodiment, battery 224 is not coupled to processor 210 during normal operation, since the power to operate security module 150 can come from meter 110. If tampering is detected by sensors 222, the control signal from sensors 222 can activate switching circuit 226 that then couples battery 224 to processor 210. Battery 224 allows processor 210 to execute the security routine even if security module 150 is not coupled to meter 110.

In an embodiment, execution of the security routine effectively renders security module 150 unusable. This can be achieved, for example, by erasing the encryption keys that are necessary for secure transactions between security module 150 and meter 110. Some transactions, such as those that attempt to modify the accounting data stored within security module 150, can also be inhibited by the security routine. However, execution of the security routine does not alter the secure postage data stored within security module 150, such as the accounting values normally associated with the ascending and descending registers. These features prevent unauthorized (i.e., fraudulent) operations involving security module 150. However, the secure postal data stored within the security module is retained and can be recovered in usable form with appropriate equipment (e.g., by the service center).

Figure 3:
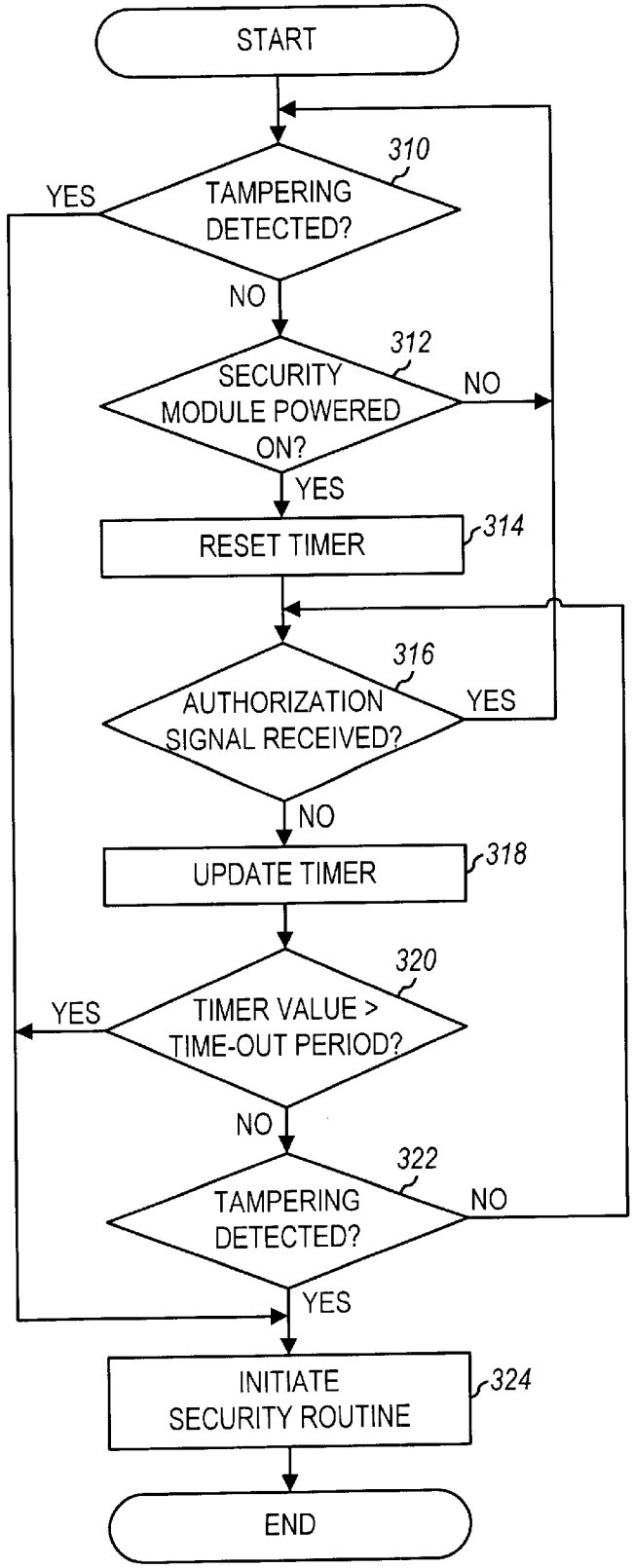
FIG. 3 illustrates a flow diagram of an embodiment of a security process of the invention.

FIG. 3 illustrates a flow diagram of an embodiment of a security process of the invention. At step 310, the process determines whether tampering has been detected. Detection of tampering can be performed by sensors 222, and can include detection of: (1)tampering with the security module housing, (2) an unauthorized attempt to change or modify the secure postage data, and other indications of fraud. If no tampering is detected, a determination is made whether security module 150 is powered on, at step 312. If the security module is not powered on, the process returns to step 310.

Otherwise, the process proceeds to step 314 and a timer (e.g., timer 212) is reset (e.g., to zero). In the embodiment shown in FIG. 3, the process checks for tampering, even while the security module is powered down, via a loop comprising steps 310 and 312.

At step 316, the process determines whether an authorization signal has been received by security module 150. If the authorization signal was received, the process returns to step 310. Otherwise, if no authorization signal was received, the process proceeds to step 318 where the timer is updated. The value in the timer is indicative of the elapsed time since the last reset of the timer. At step 320, the security module determines whether the value in timer 212 is greater than the time-out period. If the answer is no, the process proceeds to step 322 where it is again determined whether tampering was detected.

If no tampering was detected at step 322, the process returns to step 316. Otherwise, if tampering was detected at either step 310 or 322, or if it was determined at step 320 that the value in the timer is greater than the time-out period, the process initiates execution of the security routine, at step 324.

The flow chart in FIG. 3 can be modified to cover other embodiments of the security process. For example, FIG. 3 can be modified or expanded to cover detection of other indications of fraud beside the detection of tampering with the secure housing.

The foregoing description of the preferred embodiments is provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

What is claimed is:

1. A postage metering system comprising:

a meter configurable to perform a set of metering operations; and a security module operatively coupled to the meter and configured to execute a set of transactions with the meter, the security module including a processor configurable to execute a security routine upon occurrence of one or more defined events, and a memory configured to store secure postage data, wherein the security routine, when executed, inhibits selected ones of transactions between the meter and security module, and wherein the secure postage data stored within the memory is retained upon execution of the security routine.

2. The system of claim 1, wherein the security routine is stored within the security module.

3. The system of claim 1, wherein execution of the security routine is initiated upon detection of tampering with the security module.

4. The system of claim 1, wherein execution of the security routine is initiated upon receiving a command from the meter.

5. The system of claim 1, wherein the secure postage data includes values for ascending and descending registers.

6. The system of claim 1, wherein the security module further includes a secure housing that encloses the processor and the memory.

7. The system of claim 1, wherein the security module further includes a timer operatively coupled to the processor and configured to maintain a count indicative of a time period since a last reset of the timer.

8. The system of claim 1, wherein the security module further includes a battery operatively coupled to the processor and configured to provide power to the processor when no external power is received.

9. The system of claim 8, wherein the security module further includes a switch coupled between the battery and the processor.

10. The system of claim 1, wherein execution of the security routine is initiated upon a failure to receive an authorization signal within a time-out period.

11. The system of claim 10, wherein the time-out period is less than a second.

12. The system of claim 11, wherein the time-out period is in the order of milli-seconds (msecs).

13. The system of claim 1, wherein the memory is further configured to store security data.

14. The system of claim 13, wherein the security data includes a set of encryption keys.

15. The system of claim 14, wherein the encryption keys are destroyed upon execution of the security routine.

16. A postage metering system comprising:

a postage meter including a first processor and configured to perform a set of operations; and a security module coupled to the meter and configured to execute a set of transactions with the meter, the security module including a second processor configurable to execute a security routine upon a failure to receive an authorization signal within a time-out period, the security routine inhibiting selected ones of transactions between the postage meter and the security module, and a memory configured to store secure postage data that is retained upon execution of the security routine.

17. The system of claim 16, wherein memory if further configured to store security data that is erased upon execution of the security routine.

18. A method for executing a security routine within a postage metering system that includes a security module coupled to a meter, the method comprising:

detecting occurrence of one or more defined events within the postage metering system;

initiating execution of the security routine upon detection of occurrence of the one or more events; and upon execution of the security routine, inhibiting selected ones of transactions between the meter and the security module, and retaining secure postage data stored within a memory in the security module.

19. The method of claim 18, wherein the security routine is stored within the security module.

20. The method of claim 18, wherein execution of the security routine is initiated upon detection of tampering of the security module.

21. The method of claim 18, further comprising:

maintaining a count indicative of a time period since a last receipt of an authorization signal; and initiating execution of the security routine if the authorization signal is not received within a time-out period.

22. The method of claim 21, further comprising:

receiving the authorization signal; and resetting the count if the authorization signal is received within the time-out period.

23. The method of claim 18, wherein the security module includes a secure housing that encloses the memory within the security module, the method further comprising:

detecting tampering with the security module; and executing the security routine upon detected tampering with the security module.

24. The method of claim 18, further comprising:

providing power to the security module to allow execution of the security routine when external power is not received.

25. The method of claim 24, further comprising:

receiving an alert signal indicative of a detected tampering with the security module; and switching on the battery power in response to the alert signal.

26. A computer program product for executing a security routine within a postage metering system including a meter and a security module, the product comprising a computer-readable storage medium on which are stored:

code for detecting occurrence of one or more defined events within the postage metering system;

code for initiating execution of the security routine upon detection of occurrence of the one or more events;

code for inhibiting selected ones of transactions between the meter and the security module upon execution of the security routine; and code for retaining secure postage data stored within a memory in the security module upon execution of the security routine.

27. The product of claim 26, wherein the computer-readable storage medium is located in the security module.

28. The product of claim 26, further comprising:

code for maintaining a count indicative of a time period since a last receipt of an authorization signal; and code for initiating execution of the security routine if the authorization signal is not received within a time-out period.

29. The product of claim 26, further comprising:

code for detecting tampering with the security module; and code for executing the security routine upon detected tampering with the security module.

30. The product of claim 26, further comprising:

code for acknowledging receipt of the authorization signal; and code for resetting the count if the authorization signal is received within the time-out period.

* * * * *